US007950171B2

(12) United States Patent
Wurster

(10) Patent No.: US 7,950,171 B2
(45) Date of Patent: May 31, 2011

(54) ELECTRIC MINING SHOVEL SADDLE BLOCK ASSEMBLY WITH ADJUSTABLE WEAR PLATES

(75) Inventor: Andrew M. Wurster, New Berlin, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 923 days.

(21) Appl. No.: 11/853,784

(22) Filed: Sep. 11, 2007

(65) Prior Publication Data

US 2009/0067972 A1 Mar. 12, 2009

(51) Int. Cl.
*E02F 3/58* (2006.01)

(52) U.S. Cl. ..... 37/397; 37/399; 414/718; 414/728; 414/690

(58) Field of Classification Search ..... 414/718, 414/728, 690, 723, 724; 172/272, 273; 37/348, 37/397, 399, 400, 401, 396, 468
See application file for complete search history.

(56) References Cited

U.S. PATENT DOCUMENTS

| | | | | |
|---|---|---|---|---|
| 3,045,844 | A | 7/1962 | Learmont et al. | |
| 4,024,969 | A * | 5/1977 | Hedeen | 414/690 |
| 4,339,225 | A * | 7/1982 | Donnally et al. | 414/690 |
| 4,958,981 | A * | 9/1990 | Uchihashi | 414/694 |
| 5,408,767 | A * | 4/1995 | Hazama et al. | 37/396 |
| 5,469,647 | A * | 11/1995 | Profio | 37/398 |
| 6,314,667 | B1 * | 11/2001 | Rife et al. | 37/397 |
| 6,480,773 | B1 * | 11/2002 | Hilgart | 701/50 |
| 6,533,053 | B2 * | 3/2003 | Hayden | 180/53.7 |
| 6,764,270 | B1 * | 7/2004 | Bernhardt et al. | 414/718 |

* cited by examiner

*Primary Examiner* — Saúl J Rodríguez
*Assistant Examiner* — Stephen Vu
(74) *Attorney, Agent, or Firm* — Michael Best & Friedrich LLP

(57) ABSTRACT

A saddle block assembly including a main body having a shipper shaft opening through the main body bottom end, and an eccentric pin opening in the main body top end, an eccentric pin received in an eccentric pin opening in the top end of the main body, and a wear plate support. The wear plate support has a pin receiving opening, the eccentric pin being received in the pin receiving opening. Wear plates are mounted on the bottom end of the wear plate support and are adapted to bear against the top of a dipper handle.

15 Claims, 6 Drawing Sheets

ELECTRIC MINING SHOVEL SADDLE BLOCK ASSEMBLY WITH ADJUSTABLE WEAR PLATES

BACKGROUND OF THE INVENTION

The present invention relates to power shovels and, more particularly, to power shovels having a dipper for excavating earthen material. More specifically, the present invention relates to saddle block assemblies that support the dipper handle or arm.

There are many known earth moving apparatuses or the like. Typical prior art earth moving equipment or excavators use a bucket or dipper assembly, on the end of a movable arm, to scoop earthen material from horizontal or vertical faces. The dipper is normally provided with sharp teeth to dig against the surface being worked. The dipper further includes a cavity for collecting the material so removed. Once the earthen material is received within the dipper, the arm is typically moved to another location for transfer of the material. The material is usually discharged into a dump truck, onto a conveyor, or merely onto another pile of material.

Large electric mining rope shovels utilize a digging attachment comprising a stationary boom and a combination handle and dipper structure that mounts on the boom and that actively crowds and hoists into a bank in order to fill the dipper. As shown in FIG. 2, the handle 26 comprises two legs 68 that pass on either side of the boom 22. The handle 26 has gear racking 62 attached to the bottom of each leg 68. A shipper shaft 66 having an axis 58 is also mounted horizontally through the boom 22. Two pinions 70 with splines 74 are attached to the shipper shaft 66. The gear racking 62 on the handle legs 68 engages the pinion gear splines 74. An electric motor and a transmission (not shown) rotate the shipper shaft and pinions, thus causing the handle and racking to crowd and retract from the boom. Two saddle block assemblies 78 are mounted on the shipper shaft 66 and are used to keep the handle 26 in the proper position while the shovel is operating.

During operation the handle sees forces in the vertical and horizontal directions. The vertical force is a result of the separating force between the gear racking on the handle and the crowd pinion, and from digging loads. The horizontal force is due to the machine swinging, digging loads, and from inertia. The purpose of the saddle block assemblies is to withstand these forces and keep the handle in position.

For best operation, there should be only a small gap in between the handle and the saddle block. This gap is ideally between 0.125 inches (0.3175 centimeters) and 0.25 inches (0.635 centimeters). If the gap increases beyond this amount, the system begins to experience a couple of problems. First the gaps between the components contribute to large shock loads as the parts move. Second, a large gap on top of the handle allows the handle racking and the crowd pinion to separate from each other. This greatly increases the load on the gear teeth leading to broken gear teeth, rough operation, and increased noise.

As the saddle block assembly provides support for the handle, the handle is frequently crowding or retracting in order to dig in the bank or to swing the shovel. The relative motion between the components causes wear on the surfaces of the saddle block that are in contact with the handle. The saddle block assemblies are large structures; therefore it is not conducive to replace the entire saddle block assembly because it has wear on a couple of surfaces. For this reason, replaceable wear plates 160 form a part of the saddle block assembly. The wear plates 160 are much less expensive and easier to replace than an entire saddle block assembly. After the wear plates 160 have reached a certain thickness, they are discarded and new ones are installed. This leaves the integrity of the saddle block assemblies intact.

The saddle block wear plates 160 need to be adjusted on a regular basis to maintain the correct gap between the components. Rather than throw the wear plates 160 away at every adjustment, they are repositioned to increase their service life. Metal shims 164 and 168 are installed between the wear plates 160 and the saddle block assembly, as shown in FIG. 3, to maintain the proper operating gap. This procedure for adjusting the gap works but is time consuming and difficult. The shims are large but very thin which makes them difficult to handle. It is also awkward to work between the handle and the saddle block assembly. The area is covered in lubricant, the access is poor and the catwalks used to reach this area cannot provide ideal access to the wear plates 160. Since the wear plate adjustment is difficult, it may not be performed or it may be performed less frequently than needed.

BRIEF SUMMARY OF THE INVENTION

One of the objects of this invention is to provide a saddle block assembly with an easier method for adjustment of the wear plates by reducing the time needed to make the adjustment.

Another of the objects of this invention is to provide an adjusting saddle block assembly that performs the same function as the existing saddle block assemblies, but does not use shims and has the potential to reduce the maintenance time to adjust the gaps between components.

Another of the objects of this invention is to provide an adjusting saddle block assembly that can have a significant, positive impact on handle racking life and shipper shaft pinion life.

This invention provides a saddle block assembly including a main body having a shipper shaft opening through the main body bottom end, and an eccentric pin opening in the main body top end, an eccentric pin received in an eccentric pin opening in the top end of the main body, and a wear plate support. The wear plate support has a pin receiving opening, the eccentric pin being received in the pin receiving opening. Wear plates are mounted on the bottom end of the wear plate support and are adapted to bear against the top of a dipper handle.

This invention also provides a saddle block assembly including a main body having a top end and a bottom end, the main body having a shipper shaft opening through the main body bottom end. The saddle block assembly also includes a tube-receiving opening through the main body between the main body top end and main body bottom end, and a tube received in the tube receiving opening. There is also means for extending the tube, means for securing the tube in the tube-receiving opening, and a wear plate mounted on the end of the tube.

Other features and advantages of the invention will become apparent to those skilled in the art upon review of the following detailed description, claims and drawings in which like numerals are used to designate like features.

Figure 1:
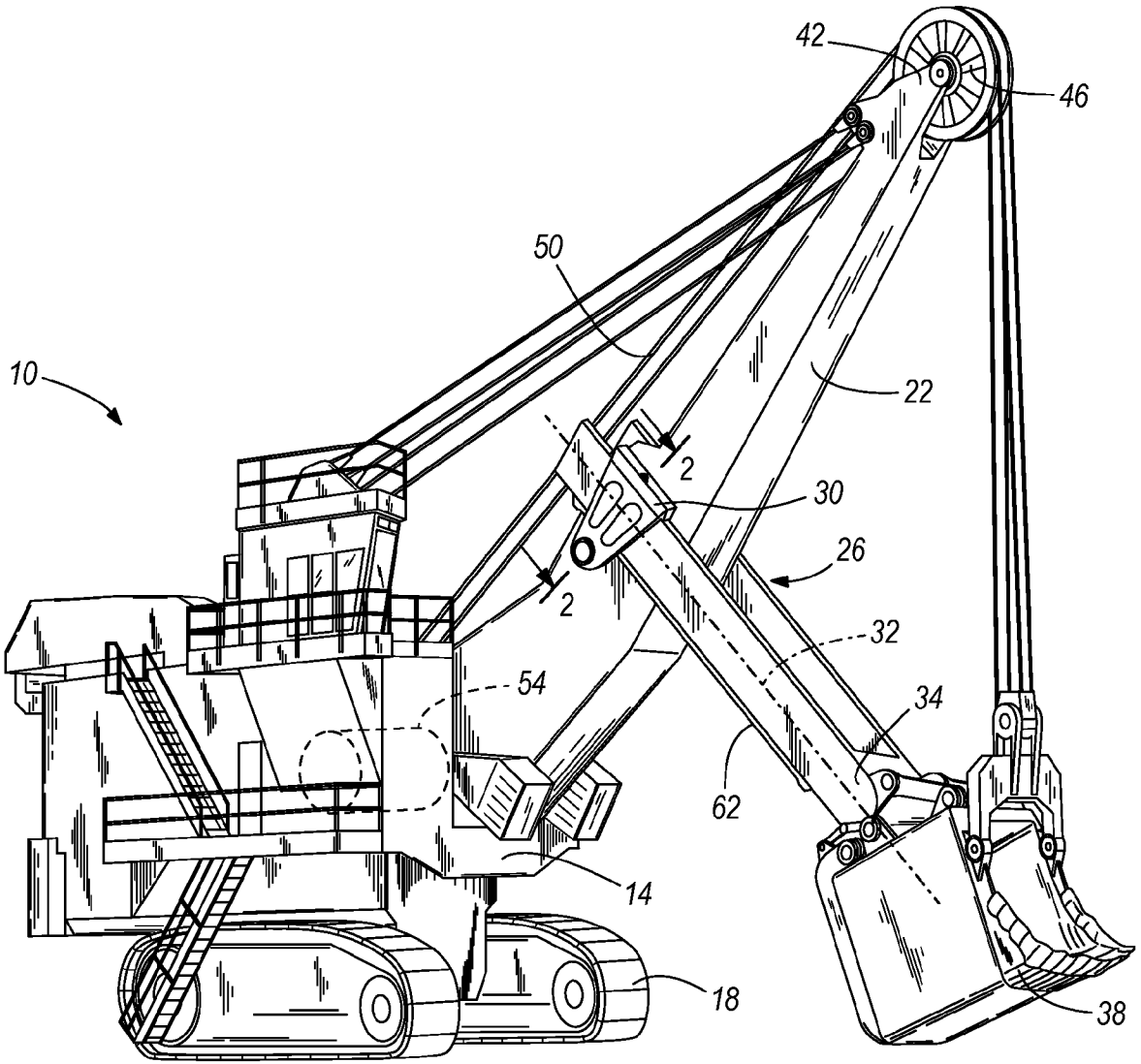
FIG. 1 is a side elevational view of a power shovel embodying the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENT OF THE INVENTION

Illustrated in FIG. 1 is a power shovel 10. It should be understood that the present invention is capable of use in other power shovels known in the art and the power shovel 10 is only provided as an example of one such power shovel. The power shovel 10 comprises a frame 14 supported for movement over the ground. Specifically, frame 14 is a revolvable housing mounted on a mobile base such as crawler tracks 18. A fixed boom 22 extends upwardly and outwardly from the frame 14. A dipper handle 26 is mounted on the boom 22 for movement about a saddle block and rack and pinion crowd drive mechanism 30 for pivotal movement relative to the boom 22 about a generally horizontal dipper handle axis 32, and for translational (non-pivotable) movement of the dipper handle 26 relative to the boom 22. The dipper handle 26 has a forward end 34. A dipper 38 is mounted on the forward end 34 of the dipper handle 26 in a conventional manner. An outer end 42 of the boom 22 has thereon a sheave 46, and a hoist cable or rope 50 extends over the sheave 46 from a winch drum 54 mounted on the frame 14 and is connected to the dipper 38.

Figure 2:
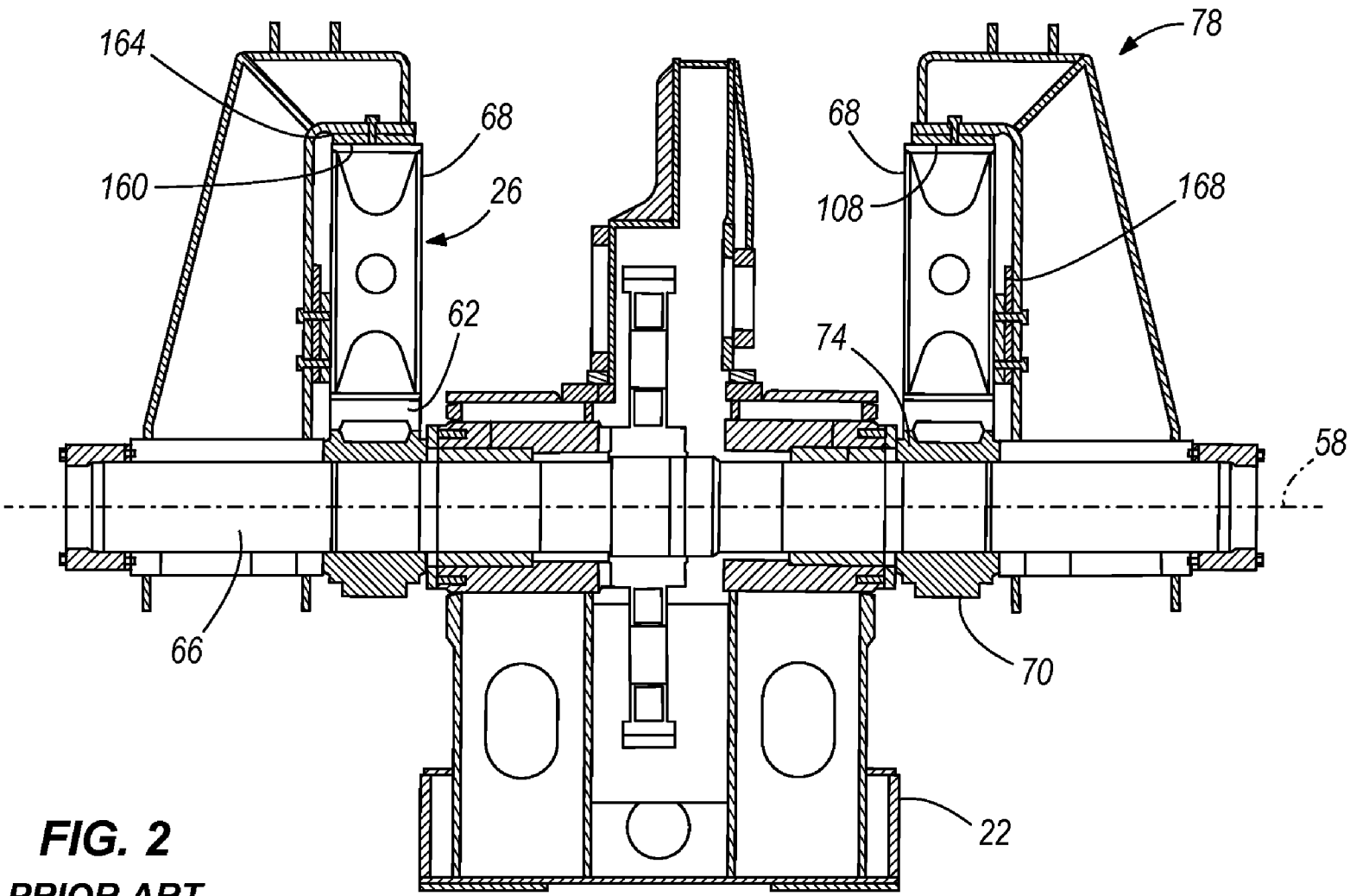
FIG. 2 PRIOR ART
FIG. 2 is a cross sectional view of the saddle block and rack and pinion crowd drive mechanism of FIG. 1, taken along the line 2-2 in FIG. 1.
Figure 3:
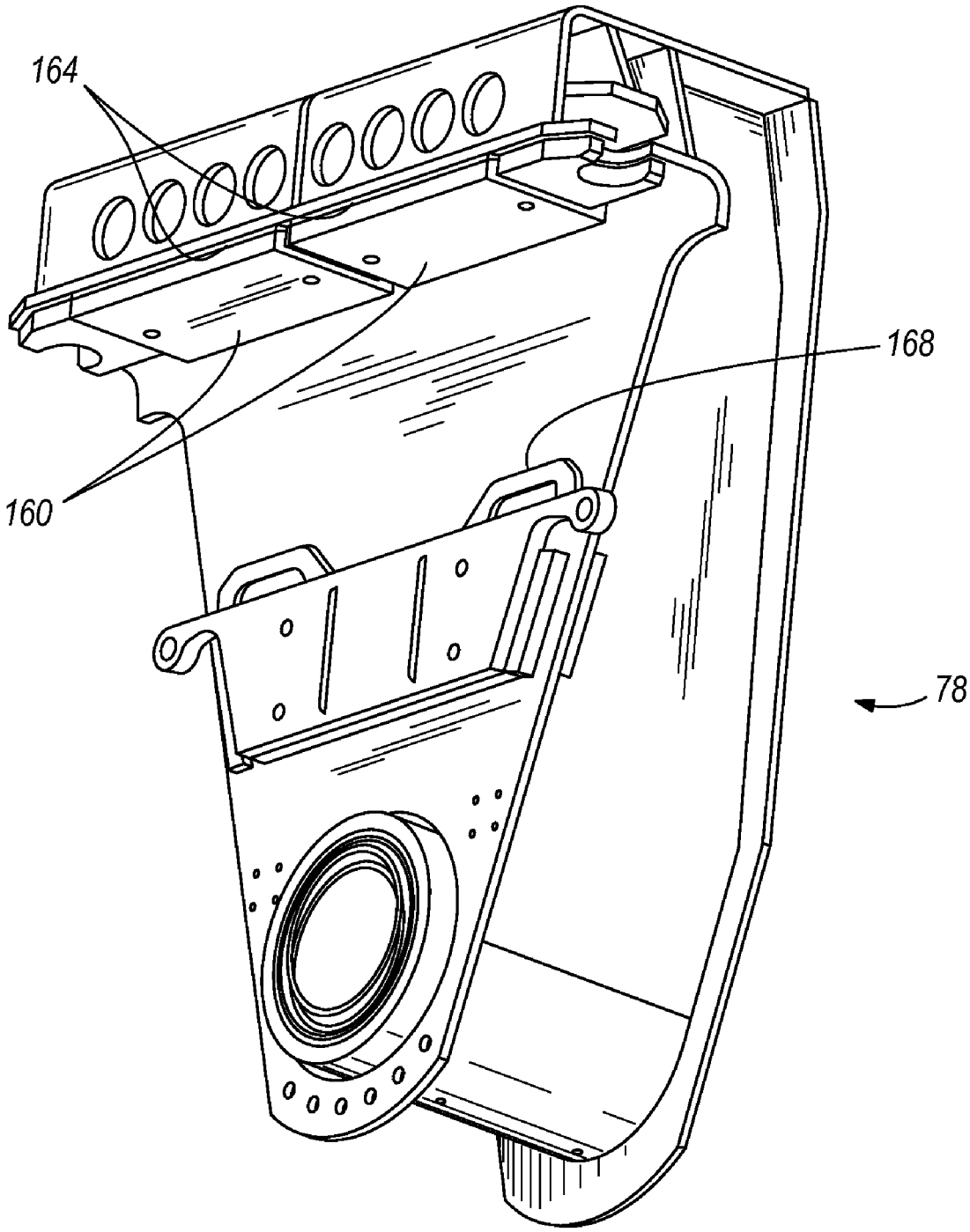
FIG. 3 PRIOR ART
FIG. 3 is a perspective view of a prior art saddle block.
Figure 4:
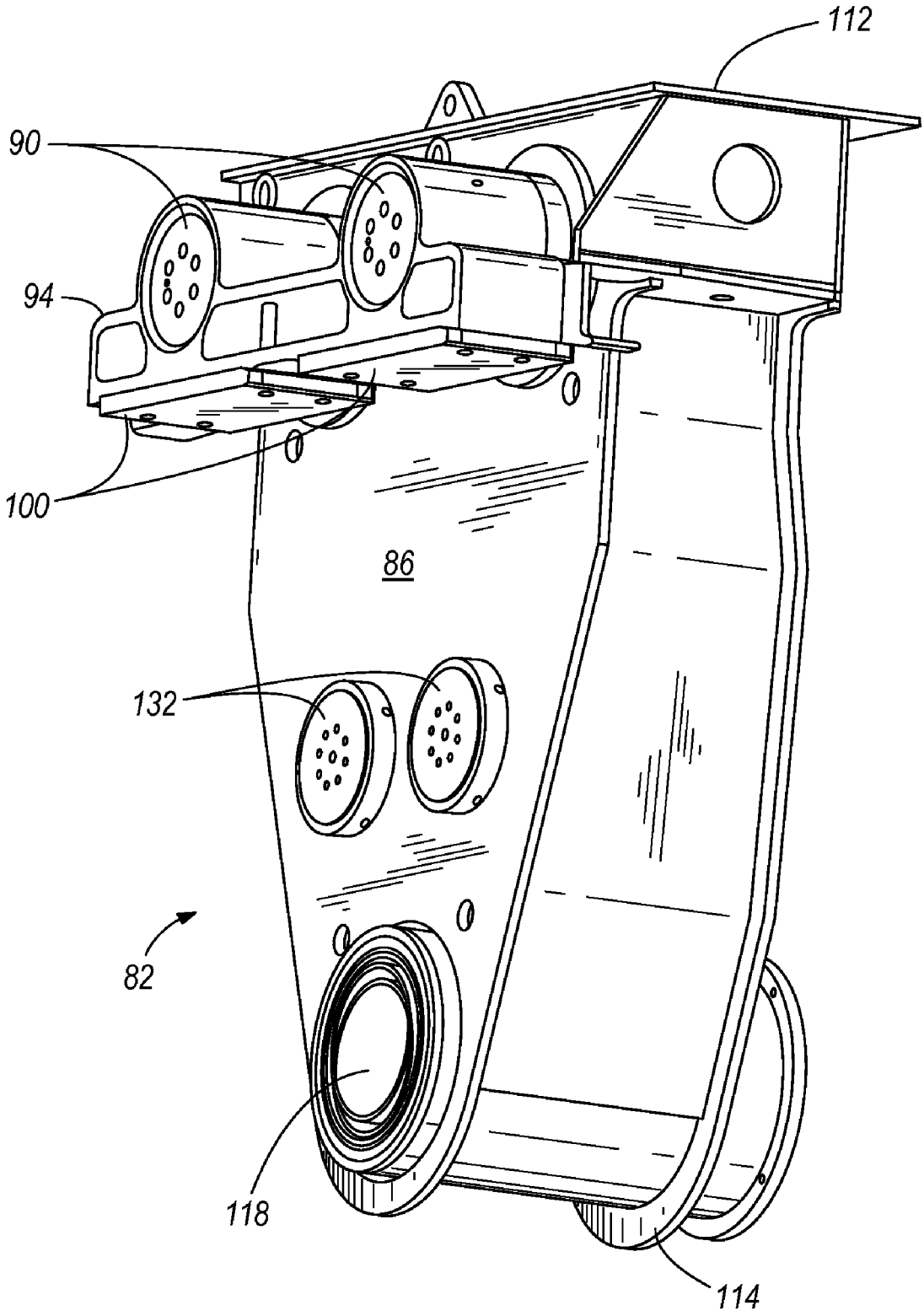
FIG. 4 is a perspective view of a saddle block according to this invention.
Figure 6:
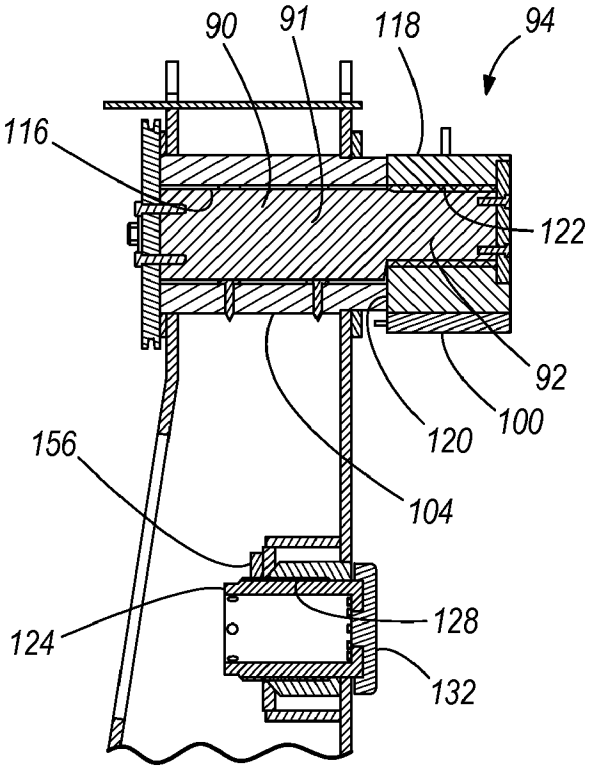
FIG. 6 is a cross sectional view of the saddle block shown in FIG. 5 taken along the line 6-6 in FIG. 5.
Figure 5:
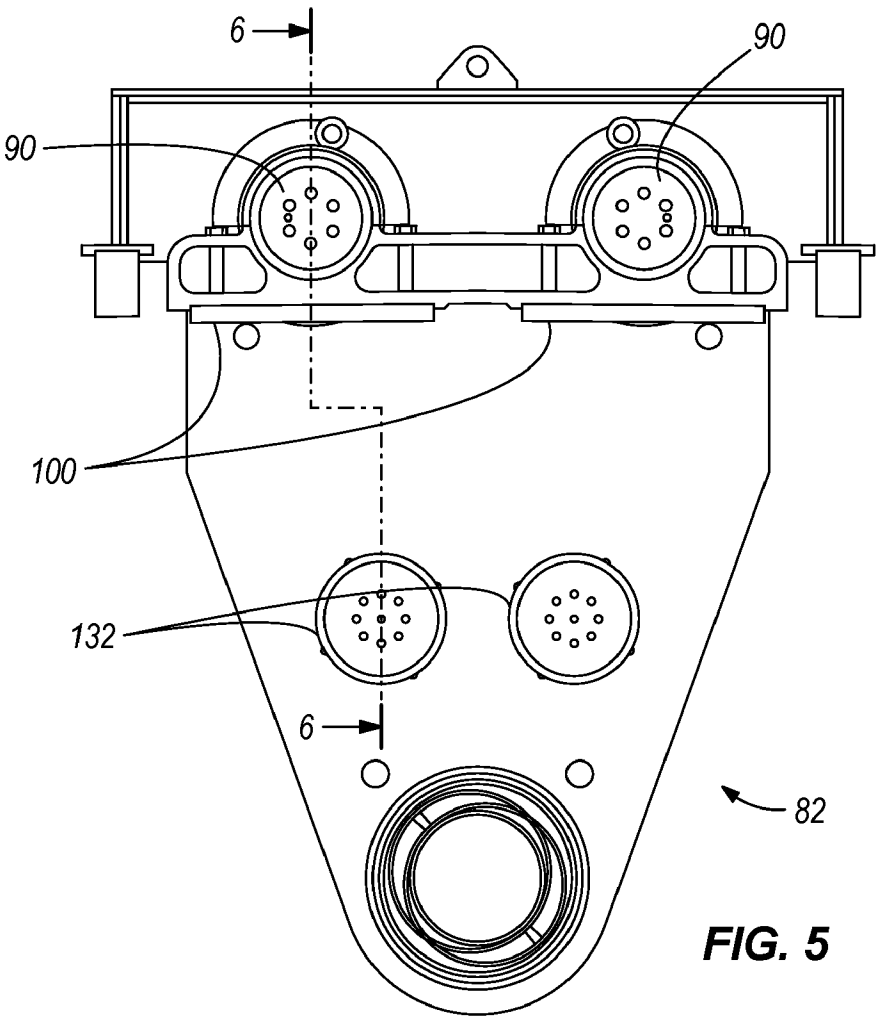
FIG. 5 is a side view of the saddle block shown in FIG. 4.

The saddle block assembly of this invention is shown in FIG. 4. The new saddle block assembly 82 is substituted for the saddle block assemblies 78 (see FIGS. 2 and 3) of the prior art. The saddle block assembly 82 includes a main body 86, two eccentric pins 90, means mounted on the main body 86 for turning the eccentric pins 90 in unison, a wear plate support or casting 94, and upper wear plates 100 mounted on the bottom end 104 (see FIG. 6) of the casting 94 and adapted to bear against the top surface 108 (see FIG. 2) of the dipper handle 26. More particularly, the main body 86 has a top end 112 and a bottom end 114, and a shipper shaft opening 118 through the main body bottom end 114. Two eccentric pin openings 116 are spaced apart at the top end 112 of the main body 86, and each of the eccentric pins 90 are received in a different one of the eccentric pin openings 116.

More particularly, the casting 94 has a top end 118 and a bottom end 120, and two pin receiving openings 122. The casting 94 receives a different one of each of the eccentric pins 90 in each of the pin receiving openings 122.

The upper wear plates 100 are attached to the casting 94 with bolts (not shown). This casting 94 is attached to the saddle block assembly 82 by the two large eccentric pins 90. An eccentric pin 90 (see FIG. 6) is a pin that has two sections 91 and 92 with different diameters that are not concentric. As the gap between the top surface 108 of the handle 26 and the upper wear plate 100 increases due to wear the eccentric pins 90 are rotated slightly. Since the pins 90 are eccentric, rotating them will cause a cam action between the pins 90 and the casting 94. This cam action changes the gap between the top surface 108 of the handle 26 and the upper wear plate 100. When the correct gap is achieved, the eccentric pins 90 are locked in place until the next adjustment.

More particularly, the means mounted on the main body 86 for turning the eccentric pins 90 in unison comprises each pin 90 having a large sprocket 136 (see FIG. 7) mounted on one end of the pin on one side 140 of the main body 86, a small double grooved sprocket 144 (shown in ghost in FIG. 7) rotatably mounted on the one side 140 of the main body 86, a first endless chain 148 trained over one of the large sprockets 136 and the small sprocket 144, and a second endless chain 148 trained over the other of the large sprockets 136 and the small sprocket 144, so that when the small sprocket 144 is rotated and the chains 148 are moved, the large sprockets 136 rotate in unison.

Figure 7:
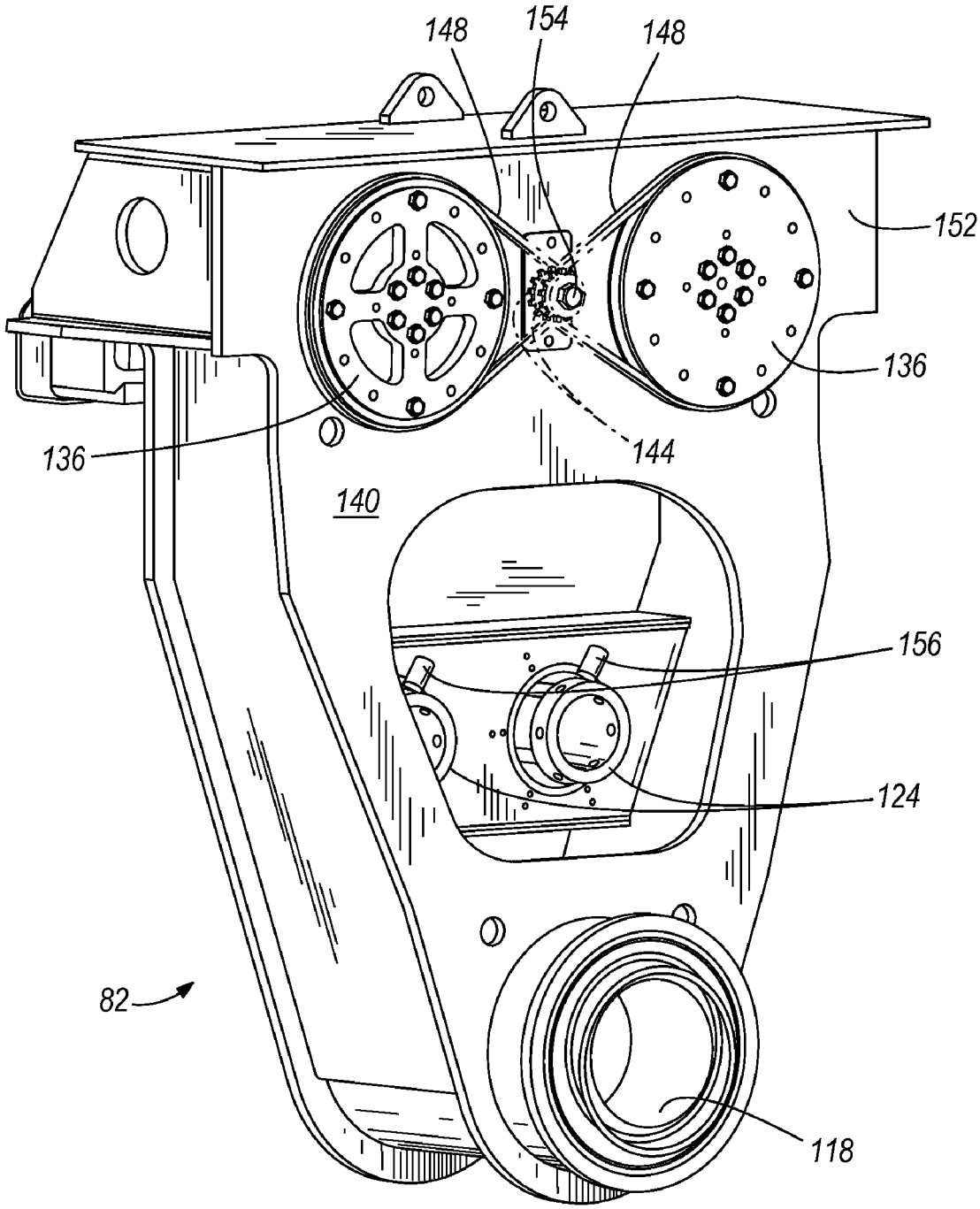
FIG. 7 is a perspective view of the back of the saddle block shown in FIG. 4.

More particularly, each of the large sprockets 136 is attached to a respective one of the outboard faces 152 of each eccentric pin 90, as shown in FIG. 7. The small sprocket 144 is keyed to an adjusting pin 154. When an adjustment is needed, the large sprockets are unlocked (locking mechanism not shown) and the adjusting pin 154 is rotated. This rotation causes the chain 148 to rotate both of the large sprockets that in turn rotate the both eccentric pins 90 together. The gap between the handle and the upper wear plate 100 changes due to the cam action of the eccentric pins 90 in the casting 94.

The saddle block assembly 82 also includes two threaded tube receiving openings 128 spaced apart in the handle horizontal movement direction. The openings 128 extend through the main body 86 between the main body top end 112 and the main body bottom end 114. The assembly 82 also includes two threaded tubes 124, each of which is received in one of the tube receiving openings 128, means for turning the tubes 124, and means for locking the tubes 124 in the tube receiving openings 128. The saddle block assembly 82 also includes two lower wear plates 132, each of which is mounted on the end of one of the tubes 124.

More particularly, when the lower wear plate loses thickness due to wear, a locking key 156 is removed and the threaded tube 124 is turned until the correct operating gap is achieved. After the gap is achieved the locking key 156 is installed again.

This saddle block assembly 82 differs from the previous saddle block assembly 78 in a number of ways. The existing saddle block assemblies 78 used wear plates that were adjusted with shims. The cam adjusting saddle block 82 uses eccentric pins 90 for the upper wear plate 100 and threaded tubes 124 for the lower wear plate 132 to adjust the gap. No shims are used to make the adjustment. The upper most wear plates on the existing saddle block assemblies 78 must be adjusted independently. The cam adjusting saddle block assembly 82 adjusts both upper wear plates 100 at the same time. This is due to the adjusting chain and sprocket assembly connected to both eccentric pins 90.

The adjusting saddle block assembly of this invention has the potential to reduce maintenance time required to adjust the wear plates. This is due to several reasons. First there are no shims to add or remove. Second both upper wear plates are attached to a casting and adjusted at the same time. Third, all adjustments are made from the outboard side of the saddle block assemblies which provides unobstructed access to all hardware.

Various features of the invention are set forth in the following claims.

The invention claimed is:

1. A saddle block assembly including a main body having a top end and a bottom end, said main body having a shipper shaft opening through the main body bottom end, and an eccentric pin opening in said top end, an eccentric pin received in said eccentric pin opening, said eccentric pin extending along a central axis, said eccentric pin having a first portion concentric with said central axis and a second portion eccentric to said central axis, a wear plate support having a top end and a bottom end, and a pin receiving opening, said wear plate support receiving said eccentric pin in said pin receiving opening, and wear plates mounted on said bottom end of said a plurality of wear plate support and adapted to bear against the top of a dipper handle.

2. The saddle block assembly in accordance with claim 1, wherein said pin receiving opening of said wear plate support receives said second portion of said eccentric pin.

3. The saddle block assembly in accordance with claim 1, wherein said eccentric pin is pivotable about said central axis.

4. The saddle block assembly in accordance with claim 3, wherein pivoting movement of said eccentric pin causes movement of said wear plates relative to said main body.

5. The saddle block assembly in accordance with claim 3, further including a first sprocket mounted on one end of said eccentric pin on one side of said main body, a second sprocket rotatably mounted on said one side of said main body, and an endless chain trained over said first sprocket and said second sprocket, rotation of said second sprocket causing movement of said chain, movement of said chain causing rotation of said first sprocket to thereby pivot said eccentric pin about said central axis.

6. The saddle block assembly in accordance with claim 1, wherein said pin receiving opening has a center, said center being offset from the central axis.

7. A saddle block assembly including a main body having a top end and a bottom end, said main body having a shipper shaft opening through the main body bottom end, a first tube-receiving opening through said main body between said main body top end and main body bottom end, a tube received in said first tube receiving opening, said tube having an end, means for extending said tube relative to said main body from a retracted position, in which said end of said tube is a first distance from said main body, to an extended position, in which said end of said tube is a second distance from said main body, said second distance being greater than said first distance, means for securing said tube in said tube receiving opening, and a first wear plate mounted on said end of said tube for movement with said end of said tube from said retracted position to said extended position.

8. The saddle block assembly in accordance with claim 7, wherein said means for extending said tube includes cooperating threads on said tube receiving opening and on said tube.

9. The saddle block assembly in accordance with claim 7, wherein said means for securing said tube includes a locking key removably engaged with said tube.

10. The saddle block assembly in accordance with claim 7, further including a second tube-receiving opening through said main body between said main body top end and main body bottom end, a second tube received in said second tube receiving opening, said second tube having an end, means for extending said second tube relative to said main body from a retracted position, in which said end of said second tube is a first distance from said main body, to an extended position, in which said end of said second tube is a second distance from said main body, said second distance being greater than said first distance, and means for securing said second tube in said second tube receiving opening.

11. The saddle block assembly in accordance with claim 10, wherein said first-mentioned tube-receiving opening and said second tube-receiving opening are spaced apart in said main body in a generally horizontal direction.

12. The saddle block assembly in accordance with claim 10, and further including a second wear plate mounted on said end of said second tube for movement with said end of said second tube from said retracted position to said extended position.

13. The saddle block assembly in accordance with claim 10, wherein said means for securing said second tube includes a second locking key removably engaged with said second tube.

14. A saddle block assembly including a main body having a top end and a bottom end, said main body having a shipper shaft opening through the main body bottom end, and two spaced apart eccentric pin openings in said top end, two eccentric pins, each of which is received in one of said eccentric pin openings, means mounted on said main body for turning said eccentric pins in unison, a casting having a top end and a bottom end, and two pin receiving openings, said casting receiving a different one of said two eccentric pins in each of said two pin receiving openings, a plurality of first wear plates mounted on said bottom end of said casting and adapted to bear against the top of a dipper handle, two threaded tube receiving openings spaced apart in a handle movement direction and through the main body between said main body top end and main body bottom end, two threaded tubes, each of which is received in one of said tube receiving openings, means for turning said tubes, means for locking said tubes in said tube receiving openings, and a plurality of second wear plates, each of which is mounted on the end of one of said tubes.

15. The saddle block assembly in accordance with claim 14 wherein said means mounted on said main body for turning said eccentric pins in unison comprises a large sprocket mounted on one end of each of said two eccentric pins on one side of said main body, a small sprocket rotatably mounted on said one side of said main body, a first endless chain trained over one of said large sprockets and said small sprocket, and a second endless chain trained over the other of said large sprockets and said small sprocket, so that when said small sprocket is rotated and said chains are moved, said large sprockets rotate in unison.

* * * * *